US005972575A

United States Patent [19]

Cabezas

[11] Patent Number: 5,972,575

[45] Date of Patent: Oct. 26, 1999

[54] METHOD FOR THE SELECTIVE SILVERING OF PHOTOGRAPHIC MATERIALS

[76] Inventor: Victoria Cabezas, Aptdo. 2961-1000, San Jose, Costa Rica

[21] Appl. No.: 09/045,273

[22] Filed: Mar. 20, 1998

[51] Int. Cl.[6] ..... G03C 7/42

[52] U.S. Cl. ..... 430/393; 430/360; 430/373; 430/414; 430/427; 430/430

[58] Field of Search ..... 430/360, 373, 430/393, 414, 427, 430

[56] References Cited

U.S. PATENT DOCUMENTS

| | | | |
|---|---|---|---|
| 2,659,674 | 11/1953 | Hyndman | 430/373 |
| 2,662,014 | 12/1953 | Umberger | 430/430 |
| 3,598,588 | 8/1971 | Mecki et al. | 430/432 |
| 3,819,372 | 6/1974 | Newman et al. | 430/140 |
| 3,819,374 | 6/1974 | Kemp | 430/12 |
| 4,197,123 | 4/1980 | Oetiker et al. | 430/360 |
| 4,269,935 | 5/1981 | Masters et al. | 430/364 |
| 4,272,613 | 6/1981 | Shibaoka et al. | 430/359 |
| 5,262,285 | 11/1993 | Darmon et al. . | |

*Primary Examiner*—Hoa Van Le
*Attorney, Agent, or Firm*—Paul S. Rooy

[57] ABSTRACT

Methods of selectively silvering photographic materials. A method for selective reflective silvering of color negative photographic materials, whereby an attractive image comprising reflective silver, black, and full color areas may be obtained, comprises the steps of developing the materials using a conventional color developer, applying a reflective silvering bath, and removing silver from selected areas of said materials. A method for selective reflective silvering of color positive photographic materials comprises the steps of developing said materials using a conventional color developer, applying a reflective silvering bath, and removing silver from selected areas of said materials.

10 Claims, 2 Drawing Sheets

METHOD FOR THE SELECTIVE SILVERING OF PHOTOGRAPHIC MATERIALS

BACKGROUND OF THE INVENTION

1. Field of the Invention

This invention relates to the development of photographic materials, and in particular to methods for the selective silvering of photographic materials.

2. Background of the Invention

The art of producing black and white, monochrome, and color photographs and other photographic materials is well-developed and understood. The steps to produce black and white or monochrome materials generally include application of a developer, a fixing bath, washing, and finally drying the developed film or paper. The production of color photographs usually includes all previously listed steps and, additionally, the application of a bleach bath, prior to the fixing bath. These basic steps have remained unchanged for decades.

A more recent development in the art is the creation of photographs which incorporate "special effects" which enhance the visual appeal of the end product. One such special effect is the "silvering" of black and white photographs.

It is known within the art that black and white, or monochrome, photographs may be treated with chemical toners or developers to produce mirror-like reflective images of metallic silver (in appearance and composition). The resulting visual effect is sometimes referred to as "silvering", "silver toning" or "mirroring".

Conventional "black and white" photographic imaging performed on films, papers or other materials coated with silver halide emulsions lacking color couplers, renders dark (usually black) metallic silver images on backgrounds having the color of the base onto which the emulsion was coated (usually white, transparent, or of a light color value). Image shadows and midtones result from exposure of the silver halides to radiant energy and their subsequent reduction to metallic silver through the use of conventional developers. Highlight qualities (such as color, texture, and composition) are given by the base material.

However, it is possible to process finished black and white photographic images, as well as films, papers, and other materials sensitized with conventional black and white photographic emulsions, with chemical toners or developers (such as Halo-Chrome toner, marketed by Rockland Colloid Corp., and Silver Bronze Mirror Developer, marketed by Tetenal) that act upon silver salts (usually silver halides) to produce mirror-like reflective images of metallic silver (in appearance and composition). The resulting visual effect is sometimes referred to as "silvering", "silver toning" or "mirroring". Herein it shall be mostly referred to as "reflective silvering" or simply "silvering" in order to describe both the visual and the chemical nature of the light-reflecting metallic silver that is produced.

It is known within the art that reflective silvering of black and white, or monochrome, photographs can be obtained through either indirect or direct processing with chemical toners or developers such as Halo-Chrome toner or Silver Bronze Mirror Developer. The end result is either silver and white or black and silver images. In the latter, black light-absorbing metallic silver is also present in the final image.

In the direct process, reflective-silvering is carried out after the black and white photographic image has been developed with a conventional black and white developer, but before it has been fixed, because fixing removes silver halides by making them soluble. Instead of a black and white photograph, the result is a black and reflective silver photograph. The black areas and the silver areas of the image differ in appearance, but both are composed of metallic silver (Ag). The background color, which is normally given by the color of the material onto which the photographic emulsion is coated, is silver "toned" because the unexposed silver halides (which are normally removed by fixing) were converted to reflective silver, rather than to the black-looking silver that results from exposure and treatment in a conventional black and white developer.

The indirect process for reflective silvering is carried out on finished (normally developed, fixed, and washed) black and white photographic images. Because they contain no silver halides, their black areas (composed of black metallic silver) must be chemically converted to silver halides or other silver salts, through the use of a "bleach" bath. After bleaching and washing, a reflective silvering toner or developer bath is applied to the photograph. The result is a silver and white photograph. Areas which were previously composed of black-looking silver become silver "toned", because the black silver is converted to a silver halide or silver salt, which is subsequently converted to reflective silver. The background remains white (or the color of the material onto which the emulsion was coated) because it contained neither silver nor silver halides or salts.

It is not known within the art that reflective-silvering may be performed on color photographs. For example, the instructions for Silver Bronze Mirror Developer make no mention of the introduction of color into silvered prints. The instructions for Halo-Chrome toner merely mention the possibility of obtaining "a colored background, if desired, by using Rockland Printint" on prints silvered through the indirect process. Although not mentioned, the photographic base (usually white) can also be colored through the use of almost any color pigment or dye (water-colors, oil paints, food dyes, etc.) to obtain a silver and color image, when combined with indirect reflective-silvering carried out with Halo-Chrome, Silver Bronze Mirror Developer, or similar toners or developers. And, of course, a silver and color image can also be obtained through indirect reflective silvering carried out on a color paper or base coated with a black and white photographic emulsion.

However, prior to the invention described herein, it was not known within the art to produce photographic images that combine areas possessing the qualities of full-color photographs with either reflective silver or black on reflective silver areas, or black. In addition, it was not known how to produce black, reflective-silver, and white (or the color of the base onto which the emulsion was coated) photographic images that may be colored, if desired, through the use of pigments, dyes, toners or other means. In addition, it was not known how to produce black, reflective silver, monochromatic color and white (or base color) photographs, that comprise areas possessing the qualities of a toned or color-coupler developed photograph (monochromatic color or monochromatic color and white) with either reflective silver, or black and reflective silver areas, to which coloring may be incorporated through the use dyes, pigments, additional toners, or other means. Finally, it was not know how to produce monochromatic color, silver, and white (or base color) photographic images, that comprise areas possessing the qualities of a toned or color coupler developed photograph with the qualities of an indirectly silvered black and white material, to which coloring may be incorporated through the use of dyes, pigments, additional toners, or other means.

SUMMARY OF THE INVENTION

Accordingly, it is an object of the present invention to provide a method for the selective reflective-silvering of photographs which produces photographs comprising areas possessing the qualities of full-color photographs with either reflective silver, black on reflective silver areas, or black areas. Method steps allowing this object to be accomplished include applying a silvering bath to the print, and selectively removing silver from areas to be colorized. Advantages associated with the accomplishment of this object include a novel and beautiful presentation of the photograph.

It is another object of the present invention to provide a method for the selective reflective-silvering of photographs which produces photographs combining areas possessing areas of black, reflective silver, and white (or the color of the base onto which the emulsion was coated) which may be colored through the use of pigments, dyes, toners or other means. Method steps allowing this object to be accomplished include applying a silvering bath to the print, selectively removing silver from areas where the base color (usually white) is to be revealed, optionally coloring these areas, and finally optionally coloring the black and silver areas. Advantages associated with the accomplishment of this object include a novel and beautiful presentation of the photograph.

It is still another object of the present invention to provide a method for the selective reflective silvering of black and white photographic materials which produces photographs containing areas of black, reflective-silver, monochromatic color and white (or base color). These photographs comprise areas possessing the qualities of a toned or color-coupler developed photograph (monochromatic color or monochromatic color and base color), reflective-silver, and/or black and reflective silver areas. These photographs may be colored through the use of pigments, dyes, toners or other means. Method steps allowing this object to be accomplished include using a color-coupler developer or toner instead of a conventional black and white developer, applying a silvering bath to the photograph, selectively removing silver from areas to be colored, optionally coloring these areas, and finally optionally coloring the black and silver areas. Advantages associated with the accomplishment of this object include a novel and beautiful presentation of the photograph.

It is still another object of the present invention to provide a method for the selective reflective silvering of black and white photographic materials which produces photographs containing areas of monochromatic color, reflective silver, and white (or base color). These images comprise areas possessing the qualities of a toned or color coupler developed photograph with the qualities of an indirectly silvered black and white material. These photographs may be colored through the use of dyes, pigments, toners, or other means. Method steps allowing this object to be accomplished include applying a color-coupler developer or toner to a finished black and white photograph, bleaching, applying a silvering bath, selectively removing silver from areas where the toned monochromatic color is to be revealed, optionally coloring these areas, and finally optionally coloring the silver areas. Advantages associated with the accomplishment of this object include a novel and beautiful presentation of the photograph.

It is yet another object of this invention to provide a method for the selective reflective silvering of photographs which may be readily performed in most photo laboratories. Design features allowing this object to be achieved include the use of readily available materials. Benefits associated with reaching this objective include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIGS. 1 and 2. Sheet two contains FIG. 3.

DETAILED DESCRIPTION OF THE PREFERRED EMBODIMENT

Figure 1:
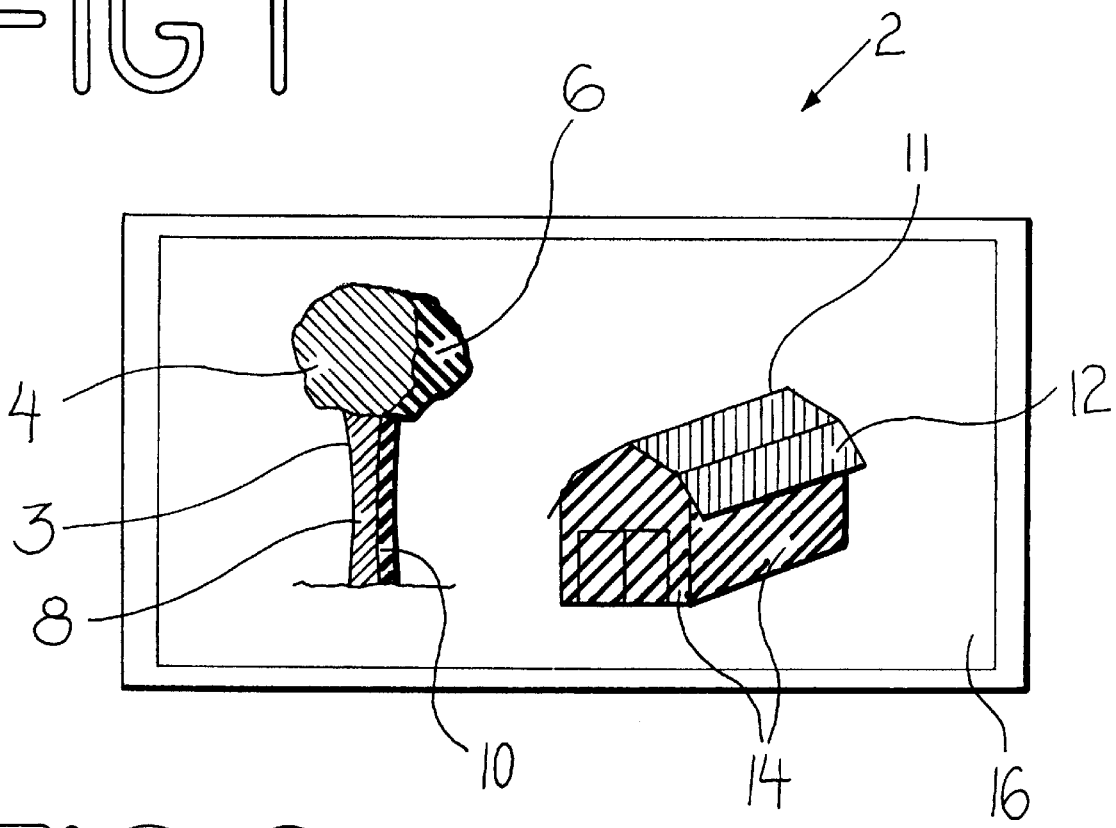
FIG. 1 is a top plan view of a conventionally developed color photograph of a tree shading a barn.

A preferred and four alternate embodiments of the instant method invention are disclosed herein. The preferred embodiment is numbered I., and is a method for selective reflective-silvering of color negative photographic materials. The first alternate embodiment is numbered II., and is a method for selective silvering of color positive photographic materials. The second alternate embodiment is numbered III., and is a method for selective reflective-silvering of black and white photographic materials. The third alternate embodiment is numbered IV., and is a method for selective reflective-silvering of black and white photographic materials which have been toned prior to direct silvering. The fourth alternate embodiment is numbered V., and is a method for selective reflective-silvering of black and white images which have been toned prior to indirect silvering.

I. Method for Selective Reflective Silvering of Color Negative Photographic Materials.

This method may be used on color negative photographic materials: films, papers or other materials (type C) having separate silver halide emulsions for recording blue, red, and green light; and for forming yellow, magenta, and cyan dyes through color coupling. Photographic materials capable of forming only one or two of these dyes may also be used, for limited color rendition, rather than full-color imaging.

A sensitized color negative photographic material is exposed to a color subject, image, or transparency (negative or positive), with conventional radiation sources, equipment, and procedures. However, over-exposure is usually desirable for increased detail in the final reflective silver areas. The color negative material may also be exposed to a black and white image or transparency if monochromatic color, rather than full-color, is desired. Higher contrast subjects, images, transparencies and/or photographic emulsions (such as those in Kodak ULTRA paper) render more dramatic results. Exposure with negative subjects or transparencies render positive images, while exposure with positive subjects or transparencies render negative images. Following exposure, the negative photographic material is processed using conventional color equipment, agitation procedures, and solution volumes, in the following manner:

A. (OPTIONAL) Pre-wet with water. This step is optional but recommended for most processing equipment. It is useful for temperature control and for avoiding streaking from uneven development. Conventional color processing time and temperature are recommended.

B. Develop with a conventional color developer, capable of reducing exposed silver halides to black metallic silver and oxidizing, so as to react with color couplers and permit the formation of color dyes, in direct proportion to the exposure to light, of the color to which the silver halides are sensitive. At the end of this step, exposed areas of photographic emulsions contain (among other things) black metallic silver and color dyes; unexposed areas contain (among other things) silver halides. Conventional color processing time and temperature are recommended.

C. (OPTIONAL) Apply a conventional stop bath, such as those contained in some color chemistry kits, or formulated for black and white photography. The formula for KODAK Stop Bath SB-1, containing water and 28% acetic acid is readily available and easy to mix. This step is optional but recommended for increased color control. The stop bath's acidic pH halts developer activity rapidly. Application during 30–60 seconds at conventional color processing temperature or room temperature is recommended.

D. Wash with abundant water in order to eliminate or dilute the chemical solution(s) used previously. Rinse time must be lengthened when a stop-bath has been used, in order to neutralize it's acidic pH. Conventional color processing time and temperature, or room temperature, are recommended.

E. Apply a reflective silvering bath (such as Halo-Chrome toner or Silver Bronze Mirror Developer), capable of converting the unexposed silver halides in the photographic emulsions to reflective-looking metallic silver. When small quantities of the reflective-silvering bath are used, solution concentrations higher to those used for conventional silvering are recommended. At the end of this step the photograph will contain, among other things, black metallic silver, reflective-looking silver and color dyes, but the color dyes remain practically invisible because they are covered by the silver surface of the photographic image. Use time and temperature recommended for reflective silvering of black and white emulsions, or, preferably, increase time, especially when small volumes are used.

F. Wash with abundant water in order to eliminate or dilute the chemical solution(s) used previously. Conventional color processing time and temperature are recommended.

G. A fixing-bath is applied to the print, in order to remove any remaining silver halides from the emulsion, by converting them to soluble salts that are finally eliminated through washing. There are many known fixing-bath formulas, ranging from simple solutions of sodium thiosulfate (also known as hypo) to baths containing hardeners and acids. The use of a non-hardening (preferably, sodium-thiosulfate based) fixer is recommended, to facilitate the removal of the silver surface which is carried out in step J. below. Solutions which combine fixing baths with bleaching baths (such as the "blix" or bleach-fix bath supplied with most color processing kits) should not be used because they remove silver from the print. It's use would therefore eliminate the reflective-silver surface created through the use the reflective-silvering toner or developer bath. The fact that the blix or bleach bath used for conventional color processing was omitted, implies that the exposed areas of the emulsions have black metallic silver, as well as dyes, whereas exposed areas of finished conventional color photographs contain no silver. Conventional color processing time and temperature, or room temperature, are recommended.

H. Wash well with abundant water, in order to eliminate all chemical residues. This, and all subsequent steps, can be carried out in full light. It is recommended that previous steps be performed with the use of light-tight equipment, such as processing drums, or in total darkness. The appearance of the image will be that of a black and silver photograph (the image will be black and the background will be reflective-looking silver), similar to the results obtainable through direct reflective-silver processing of black and white emulsions. However, the composition of the print is different because it is composed (among other things) not only of black-looking and reflective-looking metallic silver, but also of color dyes formed during color development. A full-color photograph is "hidden" under the silvered surface of the print. Conventional color processing time and temperature are recommended.

I. Dry in a conventional manner.

J. Perform selective reflective silvering. To obtain images that comprise areas possessing the qualities of full-color photographs with either reflective silver or black and reflective silver areas, silver (both black and reflective silver) must be removed from selected areas. This permits areas of the full-color photograph (previously covered by the silvered surface) to be seen. Silver removal is easily performed by applying a blix or bleach-fix bath (such as those provided with color chemistry kits), with a brush, Q-tip, cotton swab, sponge, spray, or other means.

Silver removal through the use of blix is ideal, for two reasons. First, blix contains both a bleach (which converts silver back into silver halides) and a fixer (which eliminates silver halides from the emulsion, by converting them to soluble salts that are finally eliminated through washing). And second, availability: blix is usually on hand for color processing because most color chemistry is sold in kits that contain bleach-fix. However, silver removal may also be performed by applying a bleach bath to unwanted silver areas, and subsequently applying a fixing bath to the entire print.

To avoid possible staining from chemical contact with a metal, brushes with no metal parts should be used. In the alternative, brushes with their metal parts sealed or masked may be used. Nail polish is one acceptable sealer to use for this purpose.

K. Wash well with abundant water, in order to remove all chemical residues. Conventional color processing time and temperature are recommended.

L. Dry in a conventional manner.

Figure 2:
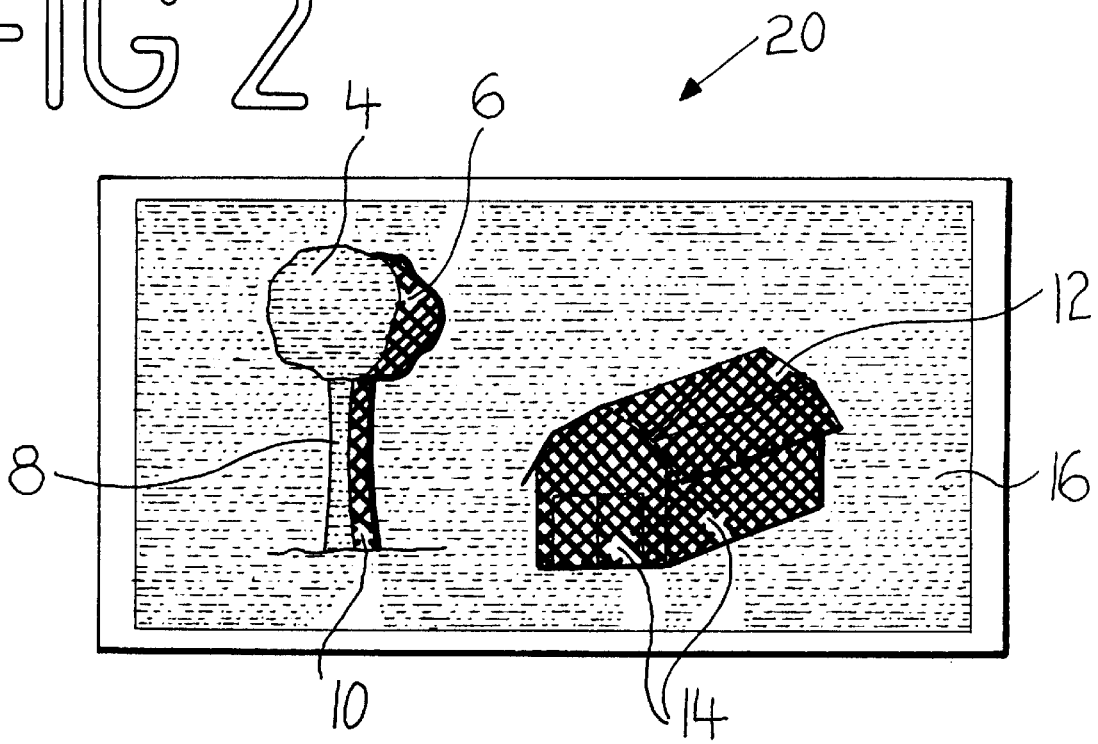
FIG. 2 is a top plan view of a tree shading a barn after the instant invention step of application of a reflective silvering bath.
Figure 3:
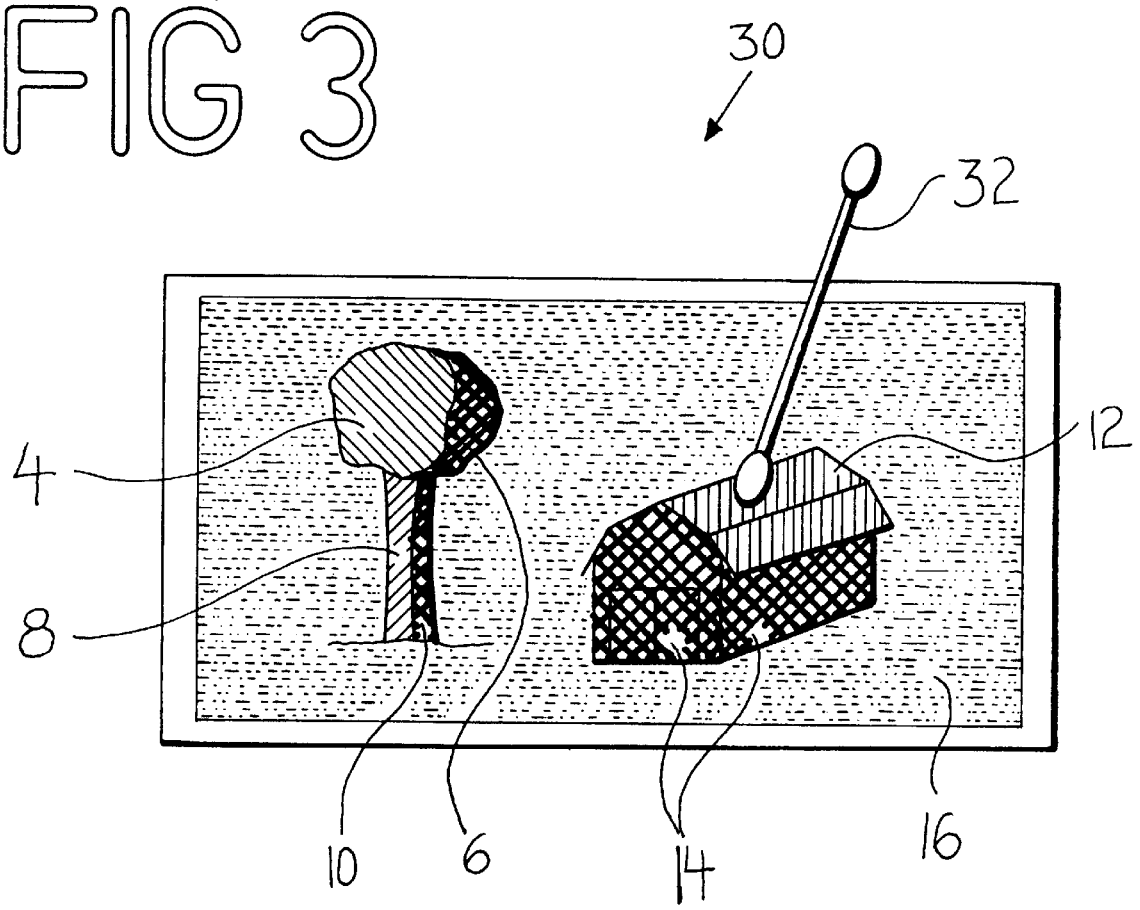
FIG. 3 is a top plan view of a tree shading a barn after the instant invention step of selective reflective silvering.

The above steps are illustrated in FIGS. 1–3. FIG. 1 is a top plan view of conventionally developed color photograph 2 of tree 3 shading barn 11. FIG. 2 is a top plan view of the same scene after the instant invention step of application of a reflective-silvering bath. FIG. 3 is a top plan view of the same scene after the instant invention step of selective reflective silvering has been performed. Thus, FIG. 1 is intended to depict a scene as it would appear on a conventionally developed photograph.

Referring now to FIG. 1, we see tree 3 shading barn 11 against sunlit snow field background 16. The sun lighting is from the upper left comer of the scene. Thus, tree 3 comprises sunlit tree top 4, shaded tree top 6, sunlit tree trunk 8 and shaded tree trunk 10. Sunlit tree top 4 is light green, as indicated by light 135° hatch lines. Shaded tree top 6 is dark green, as indicated by heavy 135° hatch lines. Sunlit tree trunk 8 is light brown, as indicated by light 45° hatch lines. Shaded tree trunk 10 is dark brown, as indicated by heavy 45° hatch lines.

Barn 11 comprises shaded barn roof 12 and shaded barn sides 14. Shaded barn roof 12 is red, as indicated by vertical hatch lines. Shaded barn sides 14 are dark brown, as indicated by heavy 45° hatch lines. Sun lit snow field background 16 is white.

For the purposes of this example, let's assume the photographer wishes to end up with a selectively silvered photograph in which the following colors occur:

Reflectively silvered: Sunlit snow field background 16.

Black: Shaded tree top 6, shaded tree trunk 10, and barn sides 14.

Natural colors: Sunlit tree top 4 (light green), sunlit tree trunk 8 (light brown), and shaded barn roof 12 (red).

Following the conventional steps of developing with a color developer and washing, the instant invention teaches the next step to be E. (see above) applying a silvering bath. While the developer bath produces black metallic silver and color dyes in indirect proportion to image light intensity, the silvering bath produces reflective silver in direct proportion to image light intensity. After it's application, high light intensity areas are silver "toned". Low light intensity areas are black because, in addition to small amounts of reflective silver, they contain large amounts of color dyes and black metallic silver, formed during developing. Low light intensity areas in silvered photograph 10 include shaded tree top 6, shaded tree trunk 10, shaded barn roof 12, and shaded barn sides 14. High light intensity areas in silvered photograph 20 include sunlit tree top 4, sunlit tree trunk 8, and sunlit snow field background 16.

Thus, as depicted in FIG. 2, following the silvering step, the following colors occur in silvered photograph 20:

Black as depicted by heavy cross-hatched lines (low light intensity areas): Shaded tree top 6, shaded tree trunk 10, shaded barn roof 12, and shaded barn sides 14.

Reflective silver as depicted by light, short horizontal dashed lines (high light intensity areas): Sunlit tree top 4, sunlit tree trunk 8, and sunlit snow field background 16

After further washing, fixing, washing again, and then drying, the instant method invention teaches step J. (see above), selective silvering. FIG. 3 depicts the conclusion of this selective silvering step in the production of selectively silvered photograph 30. Swab 32 has been used to apply blix or bleach-fix bath to those areas whose natural colors are desired to be visible: sunlit tree top 4 (light green, as indicated by light 135° hatch lines), sunlit tree trunk 8 (light brown, as indicated by light 45° hatch lines), and shaded barn roof 12 (red, as indicated by vertical hatch lines). Shaded tree top 6, shaded tree trunk 10, and shaded barn sides 14 remain black, and sun lit snow field background 16 remains reflective silvered.

The final steps are to wash and dry selectively silvered photograph 30. The result is a novel, beautiful photograph comprising reflective silver areas, black areas, and areas in their natural colors.

In the preferred embodiment, Halo-Chrome was one of the silvering agents used. Halo-Chrome is commercially available, and contains ammonia and sodium hydroxide. In the alternative, Silver Bronze Mirror Developer, or similar silvering toners and developers, may be used. Conventional bleach and/or blix was used. Commercially available bleach contains water, potassium ferricyanide and potassium bromide. Commercially available color bleach may contain water and Ferric-EDTA (Kodak BL-1). Commercially available color blix may contain water, ammonium thiosulfate, Ferric-EDTA (Kodak BL-1) and potassium iodide. Halo-Chrome bleach contains copper sulfate or chloride.

II. Method for Selective Reflective Silvering of Color Positive Photographic Materials.

Exposures with negative subjects, images or transparencies render negative images, while exposures with positive subjects, images or transparencies render positive images. The following steps will produce selective silvering of color positive materials:

A. Follow all steps for conventional color processing of color reversal (type R) photographic materials prior to the bleach or blix step. Do not apply blix or fixer, but rather us a bleach (such as that supplied with some color chemistry kits, or those sold for black and white photographic materials), capable of converting silver into silver halides.

B. Wash with abundant water in order to eliminate or dilute the chemical solution(s) used previously. Rinse time must be lengthened when a stop-bath has been used, in order to neutralize its acidic pH. Conventional color processing time and temperature, or room temperature, arc recommended.

C. Apply a reflective silvering bath (such as Halo-Chrome toner or Silver Bronze Mirror Developer), capable of converting the unexposed silver halides in the photographic emulsions to reflective-looking metallic silver. When small quantities of the reflective silvering bath are used, solution concentrations higher to those used for conventional silvering are recommended. At the end of this step the photograph will contain, among other things, black metallic silver, reflective-looking silver, and color dyes, but the color dyes remain practically invisible because they are covered by the silver surface of the photographic image. Use time and temperature recommended for reflective silvering of black and white emulsions, or preferably, increase time, especially when small volumes are used.

D. Wash with abundant water in order to eliminate or dilute the chemical solution(s) used previously. Conventional color processing time and temperature are recommended.

E. A fixing-bath is applied in order to remove any remaining silver halides from the emulsion, by converting them to soluble salts that are finally eliminated through washing. There are many known fixing-bath formulas, ranging from simple solutions of sodium thiosulfate (known, incorrectly, as hypo) to baths containing hardeners and acids. The use of a non-hardening (preferably, sodium-thiosulfate based) fixer is recommended, to facilitate the removal of the silver surface which is carried out in step H. below. Solutions which combine fixing baths with bleaching baths (such as the "blix" or bleach-fix bath supplied with most color processing kits) should not be used because they remove silver from the print. Use of such fixing baths would eliminate the reflective silver surface created through the use the reflective silvering toner or developer bath. Conventional color processing time and temperature, or room temperature, are recommended.

F. Wash well with abundant water, in order to eliminate all chemical residues. This, and all subsequent steps, can be carried out in full light. It is recommended that previous steps be performed with the use of light-tight equipment, such as processing drums, or in total darkness. The appearance of the image will be that of a light reflective silver on a darker reflective silver photograph. A full-color photograph is "hidden" under the silvered surface of the print. Conventional color processing time and temperature are recommended.

G. Dry in a conventional manner.

H. Perform selective reflective silvering. To obtain images that comprise areas possessing the qualities of a full-color photograph with reflective silver areas, silver (both black and reflective silver) must be removed from selected areas. This permits areas of the full-color image (previously covered by the silvered surface) to be seen. Silver removal is easily performed by applying a blix or bleach-fix bath (such as those provided with color chemistry kits), with a brush, Q-tip, cotton swab, sponge, spray, or other means.

Silver removal through the use of blix is ideal, for 2 reasons. First, blix contains both a bleach (which converts silver back into silver halides) and a fixer (which eliminates silver halides from the emulsion, by converting them to soluble salts that are finally eliminated through washing). And second, availability: blix is usually on hand for color processing because most color chemistry is sold in kits that contain bleach-fix. However, silver removal may also be performed by applying a bleach bath to unwanted silver areas, and subsequently applying a fixing bath to the entire print.

To avoid possible staining from chemical contact with a metal, brushes with no metal parts should be used. In the alternative, brushes with their metal parts sealed or masked may be used. Nail polish is one acceptable sealer to use for this purpose.

I. Wash well with abundant water, in order to remove all chemical residues. Conventional color processing time and temperature are recommended.

J. Dry in a conventional manner.

III. Method for Selective Reflective Silvering of Black and White Photographic Materials.

Although silvering of black and white, or monochrome, photographs is known within the art, it is hitherto unknown to selectively silver black and white or monochrome photographs. The end object of the instant invention method for selective reflective silvering of black and white photographs is to end up with a photograph which comprises some reflective silver areas, some black metallic silver areas, and also some areas in white (or base color).

The steps in the instant method for selective reflective silvering of black and white photographs are as follow:

A. Perform conventional direct processing for reflective silvering on black and white photographic material, but use a non-hardening (preferably, sodium thiosulfate based) fixer, to facilitate the removal of the silver surface which is carried out in step D. below. The result will be a black metallic silver and reflective silver photographic image.

B. Wash well with abundant water, in order to eliminate all chemical residues. This, and all subsequent steps, can be carried out in full light. Previous steps must be performed under safe-light conditions, or with the use of light-tight equipment, such as processing drums, or in total darkness. The appearance of the image will be that of a black metallic silver and reflective silver photograph. High light intensity areas will be reflective silver and low light intensity areas will be black metallic silver.

C. Dry in a conventional manner.

D. Remove silvering from those areas where the photographer desires to reveal the base color (usually white). Silver removal is easily performed by applying a blix or bleach-fix bath (such as those provided with color chemistry kits), with a brush, Q-tip, cotton swab, sponge, spray, or other means.

Removed areas (either black or silver) will be white (or the color of the base onto which the black and white photographic emulsion was coated). The result will be a black, silver, and white (or base color) photograph.

E. The white (or base color) areas may be colored, if desired, through the use of pigments, dyes, or other means.

F. The black and silver areas may be colored, if desired, through selective application (with a brush, Q-tip or use of a masking agent) of a color toner. Most toners will eliminate the reflective quality of the silver, so toning the entire print is not recommended, unless intentionally for a special effect.

IV. Method for Selective Reflective Silvering of Black and White Photographic Materials Which Have Been Toned Prior To Direct Silvering.

A. Perform direct processing for reflective silvering on black and white photographic material, but tone prior to silvering by using a color-coupler developer or toner instead of a conventional black and white developer, and use a non-hardening (preferably sodium-thiosulfate based) fixer to facilitate the removal of the silver surface which is carried out in step D. below. After toning and reflective silvering, the result will be a black and reflective silver photographic image. The toned monochromatic color and base color (usually white) image is hidden under the silvered surface of the print.

B. Wash well with abundant water, in order to eliminate all chemical residues. This, and all subsequent steps, can be carried out in full light. Previous steps must be performed under safe-light conditions, or with the use of light-tight equipment, such as processing drums, or in total darkness. The appearance of the image will be that of a black metallic silver and reflective silver photograph. High light intensity areas will be reflective silver and low light intensity areas will be black because they contain (among other things) black metallic silver and dyes.

C. Dry in a conventional manner.

D. Remove silvering from those areas where the photographer desires to reveal the color of the toned image and/or the base color (generally white). Silver removal is easily performed by applying a blix or bleach-fix bath (such as those provided with color chemistry kits), with a brush, Q-tip, cotton swab, sponge, spray, or other means.

Areas where the silvering has been removed will be the color of the toned image and the color of the base onto which the black and white photographic emulsion was coated (generally white). Areas from which the silvering has not been removed will remain either black metallic silver or reflective silver, just as they were immediately following the direct silvering step.

E. The areas from which the silvering was removed may be colored, if desired, through the use of pigments, dyes, or other means.

F. The black metallic silver and/or reflective silver areas may be colored, if desired, through selective application (with a brush, Q-tip or use of a masking agent) of a different color toner. Most toners will eliminate the reflective quality of the silver, so toning the entire print is not recommended, unless intentionally for a special effect.

V. Method for Selective Reflective Silvering of Black and White Images Which Have Been Toned Prior To Indirect Silvering.

A. Perform indirect black and white silvering conventionally, but tone prior to silvering by using a color-coupler developer or toner. After toning and indirect reflective silvering, the result will be a silver and white photographic image. The toned monochromatic color is hidden under the silvered surface of the print.

B. Wash well with abundant water, in order to eliminate all chemical residues. The appearance of the image will be that of a reflective silver and white photograph.

C. Dry in a conventional manner.

D. Remove silvering from those areas where the photographer desires to reveal the color of the toned image. Silver removal is easily performed by applying a blix or bleach-fix bath (such as those provided with color chemistry kits), with a brush, Q-tip, cotton swab, sponge, spray, or other means.

Areas where the silvering has been removed will be the color of the toned image. Areas from which the silvering has not been removed will remain either reflective silver or base color (generally white), just as they were immediately following the direct silvering step.

E. The areas from which the silvering was removed, as well as the white (or base color) areas may be colored, if desired, through the use of pigments, dyes, or other means.

F. The reflective silver areas may be colored, if desired, through selective application (with a brush, Q-tip or use of a masking agent) of a different color toner. Most toners will eliminate the reflective quality of the silver, so toning the entire print is not recommended, unless intentionally for a special effect.

While preferred and alternate embodiments of the invention has been illustrated herein, it is to be understood that changes and variations may be made by those skilled in the art without departing from the spirit of the appending claims.

DRAWING ITEM INDEX

2 conventionally developed photograph
3 tree
4 sunlit tree top
6 shaded tree top
8 sunlit tree trunk
10 shaded tree trunk
11 barn
12 shaded barn roof
14 shaded barn side
16 sunlit snowfield background
20 silvered photograph
30 selectively silvered photograph
32 swab

I claim:

1. A method for selective reflective silvering of color negative photographic materials, whereby an attractive image comprising reflective silver, black, and full color areas may be obtained, comprising the steps of:

A. developing said materials using a conventional color developer;

B. applying a reflective silvering bath, whereby unexposed silver halides on said materials are rendered reflective silver in appearance; and C. removing silver from selected areas of said materials.

2. The method for selective reflective silvering of color negative photographic materials of claim 1 further comprising the step of applying a fixing bath to said materials after applying said reflective silvering bath, said fixing bath containing no bleaching bath.

3. The method for selective reflective silvering of color negative photographic materials of claim 2 wherein said fixing bath is non-hardening.

4. The method for selective reflective silvering of color negative photographic materials of claim 2 further comprising the steps of washing and drying said materials after removing silver from selected areas of said materials.

5. A method for selective reflective silvering of color positive photographic materials comprising the steps of:

A. developing said materials using a conventional color developer;

B. applying a reflective silvering bath, whereby unexposed silver halides on said materials are rendered reflective silver in appearance; and C. removing silver from selected areas of said materials.

6. The method for selective reflective silvering of color positive photographic materials of claim 5 further comprising the step of applying a fixing bath to said materials after applying said reflective silvering bath, said fixing bath containing no bleaching bath.

7. The method for selective reflective silvering of color positive photographic materials of claim 6 wherein said fixing bath is non-hardening.

8. The method for selective reflective silvering of color positive photographic materials of claim 6 further comprising the steps of washing and drying said materials after removing silver from selected areas of said materials.

9. The method of claim 6 further comprising the following step performed after developing and before applying a reflective silvering bath:

applying a bleach capable of converting silver into silver halides.

10. The method for selective reflective silvering of color positive photographic materials of claim 5 further comprising the step of applying a bleach to the photographic materials between steps A and B, said bleach being capable of converting silver into silver halides.

* * * * *